United States Patent [19]

Waiser

[11] Patent Number: 4,771,561

[45] Date of Patent: Sep. 20, 1988

[54] REVOLVER USING CHANGEABLE CYLINDERS

[76] Inventor: Shimon Waiser, P.O. Box 360, Midwood Station, Brooklyn, N.Y. 11230

[21] Appl. No.: 98,987

[22] Filed: Sep. 21, 1987

[51] Int. Cl.[4] ..... F41C 1/00

[52] U.S. Cl. ..... 42/59; 42/66; 42/68; 42/89

[58] Field of Search ..... 42/89, 70.08, 63, 68, 42/59, 62, 66

[56] References Cited

U.S. PATENT DOCUMENTS

| | | | |
|---|---|---|---|
| 573,736 | 12/1896 | Wesson et al. | 42/70.08 |
| 635,705 | 10/1899 | Wesson et al. | 42/66 |
| 3,163,951 | 1/1965 | Lewis | 42/59 |
| 3,387,399 | 6/1968 | McClenahan | 42/62 |
| 3,978,603 | 9/1976 | Murabito | 42/66 |
| 3,982,346 | 9/1976 | Pilorget | 42/68 |
| 3,988,847 | 11/1976 | Kennedy | 42/66 |
| 4,318,239 | 3/1982 | Phillips, Jr. et al. | 42/89 |
| 4,402,153 | 9/1983 | Peter et al. | 42/89 |
| 4,558,530 | 12/1985 | deWitt | 42/59 |
| 4,577,429 | 3/1986 | Waiser | 42/59 |

FOREIGN PATENT DOCUMENTS

| | | | |
|---|---|---|---|
| 491673 | 6/1919 | France | 42/89 |
| 221958 | 6/1942 | Sweden | 42/89 |
| 11752 | of 1896 | United Kingdom | 42/89 |

*Primary Examiner*—Charles T. Jordan
*Assistant Examiner*—Michael J. Carone

[57] ABSTRACT

A revolver uses removable cylinders for fast reloading and has cylinder fastening elements which permit reloading of the revolver only when a revolver hammer is in an uncocked position. The revolver cylinders have, in their rear ends, cartridge holding elements which prevent cartridges from falling out of the cylinders when the cylinders are outside of the revolver frame.

21 Claims, 4 Drawing Sheets

1
1a
1b
1c
1d
1e
2
3
3a
4
4a
4b
4c
5
5a
6
7
8
9
10
10a
11a
11b
13
14
15

16b
16a
16

17
4a
16
16a
4c
6
4

8
11b
11a
10
12
1
11

8
11a
11b
10a
10

8
10
11a
11b
1
11
12

8
11a
11b
10a
10

REVOLVER USING CHANGEABLE CYLINDERS

This invention relates to revolvers and it has reference more particularly to improvement in removable revolver cylinders and cylinder mounting means.

The known revolver usually has one cartridge cylinder which is rotatable mounted in a cylinder recess of a revolver frame and which can swing out for reloading, which takes relatively long time in comparison to reloading of a semi-automatic pistol.

In U.S. Pat. No. 4,577,429 this problem was solved. But several problems were not taken into account by said patent, namely, how to prevent cartridges from falling out from a spare cylinder when it is out of a cylinder recess of the revolver frame, especially, if it is in a user's hand, pocket or other place for storage. It was also not taken into account how to prevent the revolver from discharging a shot when the cylinder is not properly mounted in the cylinder recess of the frame.

This and other difficulties experienced with the design of prior art devices have been obviated in a novel manner by the present invention.

It is an object of the present invention to provide changeable revolver cylinders with cartridge holding means fixing cartridges in cartridge holes of the cylinder when the latter is out of a cylinder recess of a revolver frame.

Another object of the present invention is to provide a revolver, which uses changeable cylinders, with an interlock preventing a revolver hammer from striking a cartridge if the cylinder is not properly mounted in the cylinder recess of the frame.

It is a further object of the present invention to provide a revolver with cylinder stopping means stopping the cylinder during a cylinder insertion in the cylinder recess of the frame and employing for this purpose a shallow recess in a front surface of the cylinder recess of the frame and a low projection on a front surface of the cylinder.

Other objects and advantages of the present invention will be apparent from the accompanying description when considered in conjunction with the following drawings, in which.

Figures 1, 2, 3, 4:
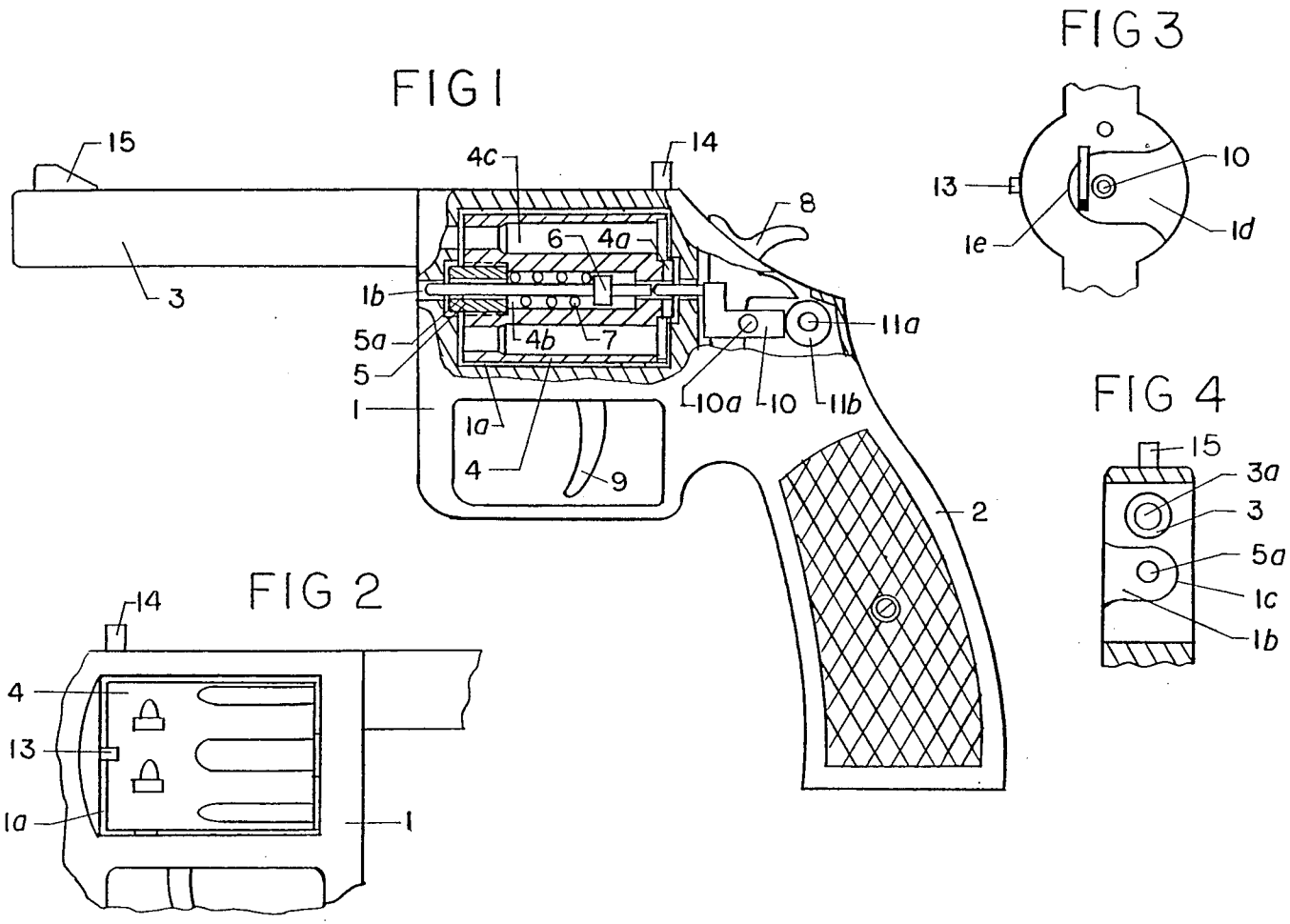
FIG. 1 is a side elevation, partly in longitudinal vertical section, of the revolver according to the present invention.
FIG. 2 is a fragmentary view of the right hand side of the revolver of FIG. 1.
FIG. 3 is a fragmentary view of the rear surface of the cylinder recess in the revolver frame.
FIG. 4 is a fragmentary view of the front surface of the cylinder recess in the revolver frame.

Referring more in detail to the drawings, and first to the revolver disclosed in FIGS. 1,2,3,4,5,6,7 and 8. The revolver may be seen to comprise a frame 1, a handle 2 and a barrel 3.

The frame comprises:

A cylinder recess 1*a* in which a cylinder 4 is removably and rotatably mounted. This cylinder 4 is equipped at its rear end with a ratchet gear 4*a* and has an elongated cylinder chamber 4*b* plugged from the front end with a plug 5 having an opening 5*a* in it. In the elongated cylinder chamber 4*b* and in the opening 5*a* is located a spring loaded displaceable member 6 having a flange that is under the action of a spring 7 and having a length at least approximately equal to a length of the cylinder. The cylinder recess 1*a* has a front surface and a rear surface. The front surface is supplied with a shallow recess 1*b* containing a low projecting part of the plug 5 and having an edge 1*c* which stops the cylinder 4 in the recess 1*a* during cylinder insertion into the recess 1*a*. The rear surface of the recess 1*a* is equipped with a shallow recess 1*d* containing a ratchet gear 4*a* and having an edge 1*e*.

A cavity 1*b* to receive a front end of the displaceable member 6 when the cylinder 4 is mounted in the cylinder recess 1*a* of the frame.

A spring loaded hammer 8 which is pivotally mounted in the frame 1.

A pivotally mounted trigger 9.

A cylinder locking rod 10 the front end of which enters into a narrower part of the rear of the chamber 4*b* to fasten the cylinder 4 in the cylinder recess 1*a* of the frame. This rod 10 has a projecting knob 10*a* accessible to a user.

A latch 11 which locks the locking rod 10, when the latter is fastening the cylinder 4. This latch 11 has a projecting knob 11*a* accessible to a user and a flange 11*b* which is under the action of a spring 12.

A small detent 13 which helps to fix the cylinder 4 in the cylinder recess 1*a* of the frame with speed during reloading of the revolver and which is positioned at a distance equal or a little greater than a radius of the cylinder from the axis of cylinder rotation when the cylinder is in the working position in the cylinder recess 1*a* of the frame.

A rear sight 14.

The barrel 3 has a bore 3*a* and a front sight 15.

When the cylinder 4 is loaded and fastened in the recess 1*a* of the frame 1, the revolver can be operated in the usual manner. If a shooter has all the cartridges discharged, he needs to replace the cylinder with a spare one having new cartridges. To replace the cylinder the shooter should press the knob 11*a* moving the latch 11 to the left (see FIG. 6). The flange 11 disconnects from the cylinder locking rod 10 and the latter under the action of the displaceable member 6, which in turn is under the pressure of the spring 7, moves to the right (see FIG. 8). The cylinder 4 can now be removed from the cylinder recess 1*a* of the frame 1 because the front end of the locking rod 10 is out from the narrower part of the rear of the chamber 4*b* and the front end of the displaceable member 6 is out from the cavity 1*b*.

To install a new cylinder in the recess 1*a* of the frame 1 the shooter should push the new cylinder into the recess 1*a* until the low projecting part of the plug 5 contacts the edge 1*c* of the shallow recess 1*b* and the rear of the lateral surface of the cylinder contacts the detent 13. In this position the front end of the displaceable member 6 is located against the cavity 1*b* and the front end of the locking rod 10 is located against the narrower part of the rear of the chamber 4*b* and can be pushed into said narrower part. Now the shooter pushes the knob 10*a* to the left (see FIGS. 1 and 7) moving the front end of the rod 10 into the narrower part of the rear of the chamber 4*b* and the front end of the displaceable member 6 into the cavity 1*b* thereby fastening the cylinder in the recess 1*a* of the frame 1. At the end of this movement of the rod 1O the rear part of the rod 10 releases the flange 11*b* of the latch 11 and the latter under the action of the spring 12 moves to the right (see FIG. 5) and locks the rod 10 (see FIG. 7) preventing the rod 10 from movement rearwardly. The revolver is ready again for shooting.

Figures 5, 6, 7, 8, 9, 10:
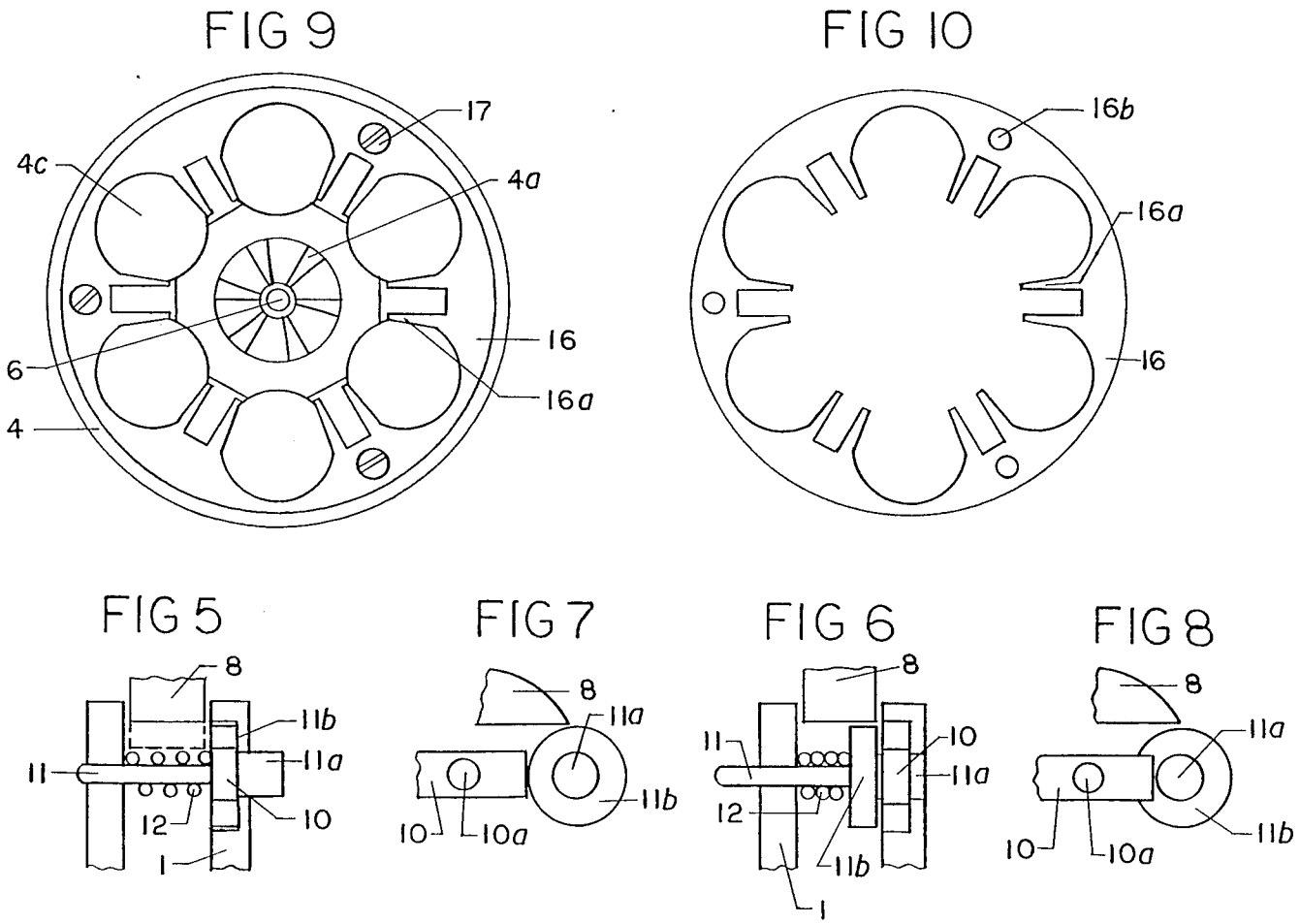
FIG. 5 shows a relative position of sorme cylinder fixing parts and the revolver hammer when the cylinder is fixed in the cylinder recess of the frame.
FIG. 6 shows a relative position of the parts shown in FIG. 5 when the cylinder is not fixed in the cylinder recess of the frame.
FIG. 7 shows a side view of the parts shown in FIG. 5 except the revolver frame.
FIG. 8 shows a side view of the parts shown in FIG. 6 except the revolver frame.
FIG. 9 shows the enlarged rear end of the revolver cylinder with the cartridge holding element mounted on the rear end of the cylinder.
FIG. 10 shows the enlarged cartridge holding element with resilient projections which contact lateral surfaces of cartridges.

The above described replacement of the cylinders is possible because the hammer 8 is in the uncocked position and its rear bottom part does not block the flange 11*b* of the latch 11 from movement to the left (see FIG. 6). But if the hammer 8 is cocked then its rear part is located in the position shown by dotted line in FIG. 5 and the flange 11*b* is blocked by the rear part of the hammer 8 and can not move to the left and the cylinder replacement is impossible.

On the other hand if the recess 1*a* of the frame 1 does not contain the cylinder 4 and the hammer 8 is cocked, then the insertion of the cylinder in the recess 1*a* of the frame is impossible because the rear bottom part of the hammer 8, when the latter is in the cocked position, blocks the flange 11*b* of the latch 11 from movement to the left (see dotted line in FIG. 5) and the flange 11*b* in turn prevents the rod 10 from movement to the right (see FIGS. 1 and 7) and the front part of the rod 10, which projects in the cylinder recess 1*a* of the frame 1, prevents the cylinder from being inserted into the recess 1*a* of the frame.

It is understood from aforesaid that the cylinder replacement can not be done if the hammer is in the cocked position because the hammer can strike a primer of a cartridge when the cylinder is not fastened properly in the frame and an accident can happen.

It should be mentioned that the edge 1*e* of the recess 1*d* can be used to stop the cylinder 4 during the cylinder insertion in the recess 1*a* of the frame 1 instead of using the detent 13 which can be eliminated. For this purpose the edge 1*e* of the recess 1*d* should be so located that it contacts the ratchet wheel 4*a* of the cylinder 4 when the latter reaches the proper position during the cylinder insertion in the recess 1*a* of the frame 1.

FIGS. 9–15 show four modifications of cartridge holding means which fasten cartridges preventing them from falling out from cartridge holes (chambers) 4*c* of the cylinder 4 when the latter is out of the cylinder recess of the frame.

Figure 11:
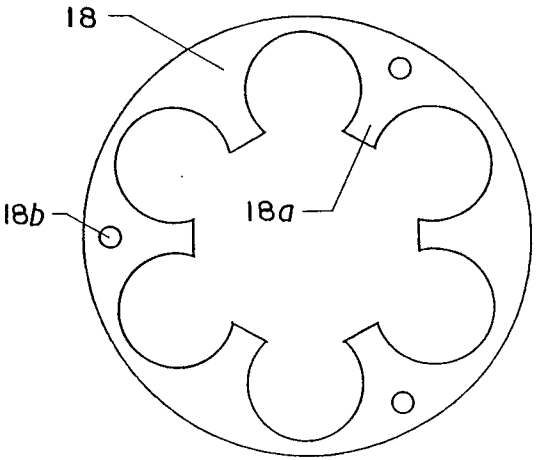
FIG. 11 shows the enlarged additional auxiliary detail which may cover the cartridge holding element of FIG. 10 to prevent longitudinal bending of the resilient projections of the cartridge holding element of FIG. 10 when cartridge cases are being removed from the cartridge holes in the cylinder.

The first modification of the cartridge holding means is shown in FIGS. 9, 10 and 11. These means are installed in a shallow recess in the rear end of the cylinder 4 and include a cartridge holding member 16 made of flat spring steel and having twelve resilient contacts 16*a* which partially close the cartridge holes 4*c* of the cylinder 4 and which move apart to pass the cartridges into the holes 4*c* and to press lateral surfaces of the cartridges for the purpose of fastening the cartridges in the holes 4*c*. The member 16 is fixed in the shallow recess in the rear end of the cylinder 4 by three screws 17. The additional auxiliary detail (washer) 18 may be mounted on the cylinder end on top of the member 16. This detail 18 is not made of resilient material and has six projections 18*a* a which partially cover the twelve contacts 16*a* of the member 16 to prevent the contacts 16*a* from being bent during removing empty cartridge cases from the holes 4*c*. If the member 16 is thick enough then there is no necessity for the additional auxiliary detail 18. The member 16 has three holes 16*b* and the detail 18 has three holes 18*b* through which the three screws 17 pass to fasten the member 16 and the detail 18 in said shallow recess of the rear end of the cylinder.

To load the cylinder 4 with cartridges the user has to insert the cartridges into the holes 4*c* of the cylinder 4. During this insertion each cartridge moves apart two contacts 16*a* of the member 16 and because said contacts 16*a* are resilient they press the lateral surface of the cartridge fixing the latter in the cartridge hole 4*c* of the cylinder 4 thereby preventing the cartridge from falling out of the cartridge hole 4*c* of the cylinder 4.

Figure 12:
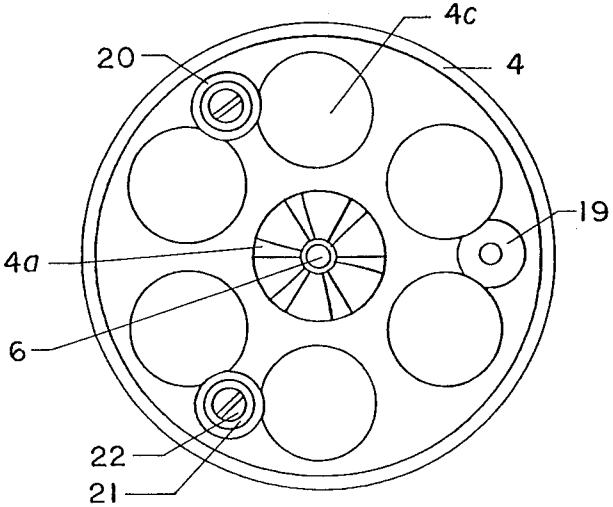
FIG. 12 shows the enlarged rear end of the revolver cylinder having a second modification of cartridge holding elements mounted on the rear end of the cylinder with one of said elements removed for explanatory purpose.

Referring now to FIG. 12 wherein is shown the second modification of cartridge holding means.

In the rear end of the cylinder 4 (see FIG. 12) there are three shallow recesses 19 in which three rubber discs 20 are located with holes for screws 22 to go through. There is a washer 21 between the head of the screw 22 and the disc 20 to prevent penetration of the screw head into the rubber disc 20. As it is seen in FIG. 12 the disc 20 partially closes the cartridge hole 4*c* of the cylinder 4 so that when a cartridge is in the hole 4*c* the lateral surface of the cartridge is pressed by the disc 20. The disc 20 fixes the cartridge in the hole 4*c* of the cylinder 4 by this action thereby preventing the cartridge from falling out of the cartridge hole 4*c*.

Figure 13:
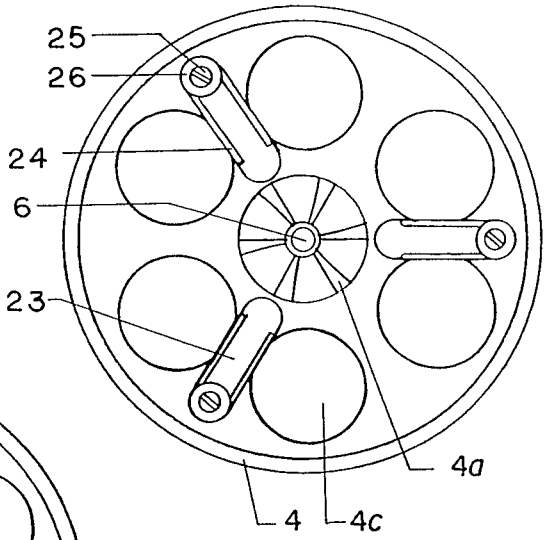
FIG. 13 shows the enlarged rear end of the revolver cylinder having a third modification of cartridge holding elements mounted on the rear end of the cylinder.

Referring to FIG. 13 wherein is shown the third modification of cartridge holding means.

In the rear end of the cylinder 4 there are three shallow recesses 23 in which three springs 24 are located. The springs 24 are immovably fixed in the recesses 23 by three screws 25 and three washers 26 which can be eliminated if the heads of the screws 25 are large enough. As it is seen in FIG. 13 the spring 24 partially closes the cartridge holes 4*c* of the cylinder 4 so that when a cartridge is in the hole 4*c*, the lateral surface of the cartridge is pressed by the spring 24. The spring 24 fixes the cartridge in the hole 4*c* of the cylinder 4 by this action thereby preventing the cartridge from falling out of the cartridge hole 4*c*.

Figure 14:
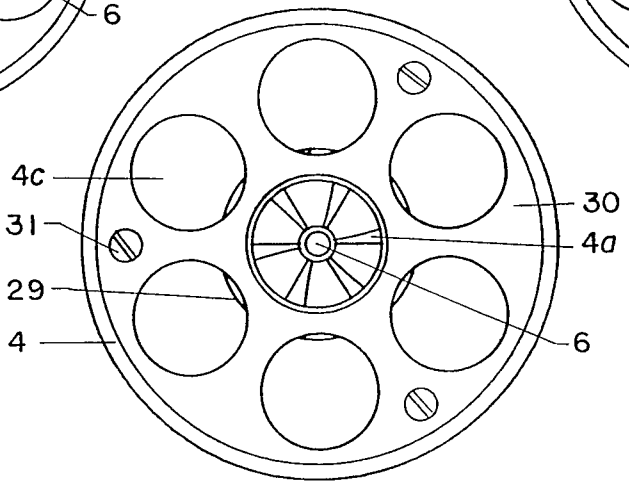
FIG. 14 shows the enlarged rear end of the revolver cylinder having a forth modification of cartridge holding element mounted on the rear end of the cylinder.
Figure 15:
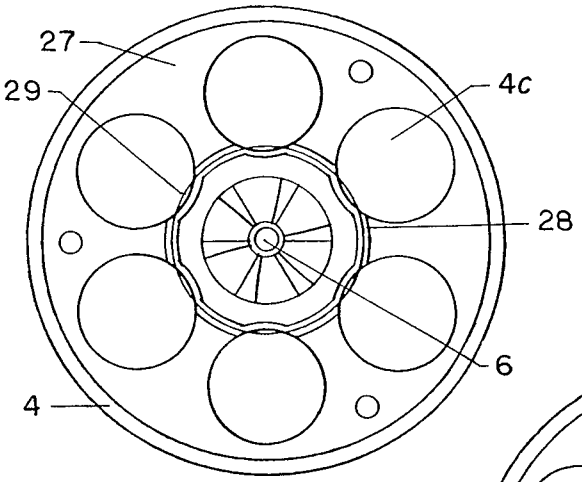
FIG. 15 is a view similar to FIG. 14 when the cover, which fixes the cartridge holding element in the rear end of the cylinder, is removed.

Referring to FIGS. 14 and 15 wherein is shown the fourth modification of cartridge holding means.

In the rear end of the cylinder 4 there is a recess 27 and another very narrow O-shaped recess 28 which is deeper than the recess 27. A ring 29, which is made of spring wire, is located in the recess 28. The recesses 27 and 28 are covered by a cover plate 30 to prevent the ring 29 from slipping out of the recess 28. The cover plate 30 is fixed in the cylinder 4 by three screws 31. As it is seen in FIGS. 14 and 15 the ring 29 partially closes the cartridge holes 4*c* of the cylinder 4 so that when cartridges are in the holes 4*c*, the lateral surfaces of the cartridges are pressed by the ring 29. The ring 29 fixes the cartridges in the holes 4*c* of the cylinder 4 by this action thereby preventing the cartridges from falling out of the cartridge holes 4*c*.

It is obvious that the O-shaped recess 28 can be made in the cover plate 30, if the latter is thick enough, instead of being made in the cylinder 4. If so the ring 29 will be located in the cover plate 30 and the functioning of the cartridge holding means is the same as it is described for the fourth modification of the cartridge holding means.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a revolver having a barrel, a frame, a hammer movable between cocked and uncocked positions, a cylinder, a cylinder recess in the frame, cylinder fastening means to fasten the cylinder in working position in which the cylinder is rotatable mounted in said cylinder recess of the frame, said cylinder fastening means including:

(1) a first element having a position one, in which said first element fastens said cylinder in said working position, and a position two, in which said first element does not fasten said cylinder in said working position;

(2) a second element having a locking position, in which said second element locks said first element in said position one, and a releasing position, in which said second element does not lock said first element in said position one;

(3) said first element and said second element being movable relative to each other;

(4) said second element arranged so that in said locking position said second element permits said hammer to move from said cocked position to said uncocked position and vice versa and in said releasing position said second element blocks said hammer in said uncocked position when the hammer is not cocked.

2. The invention as defined in claim 1 wherein said second element is spring loaded by a spring so that said spring forces said second element to move to said locking position when there is no obstruction to move so.

3. The invention as defined in claim 1 wherein said first element is permitted to perform a longitudinal movement of said first element.

4. The invention as defined in claim 1 wherein:

(1) said cylinder has an axis of cylinder rotation;

(2) said cylinder has an elongated cylinder chamber having a first and a second ends and having a centre axis coinciding with the axis of cylinder rotation;

(3) said elongated cylinder chamber containing:

(a) a displaceable member having a first and a second ends and having a length at least approximately equal to the length of the cylinder, (b) biasing means which urge said displaceable member toward an initial position in which said first and second ends of the displaceable member do not project from the first and second ends of said elongated cylinder chamber;

(4) said first end of the displaceable member is under the action of said first element when the cylinder is in the working position;

(5) said frame has cavity adjacent the second end of the elongated cylinder chamber to receive the second end of the displaceable member when the first end of the displaceable member is pressed by said first element and the cylinder is in the working position.

5. In a revolver having a barrel, a frame, a hammer movable between cocked and uncocked positions, a cylinder, a cylinder recess in the frame, cylinder fastening means to fasten the cylinder in a working position in which the cylinder is rotatable mounted in said cylinder recess of the frame, said cylinder fastening means including:

(1) a first element having a position one, in which said first element fastens said cylinder in said working position, and a position two, in which said first element does not fasten said cylinder in said working position;

(2) a second element having a locking position, in which said second lement locks said first element in said position one, and a releasing position, in which said second element does not lock said first element in said position one;

(3) said first element and said second element being movable relative to each other;

(4) said hammer arranged so that said hammer in said cocked position blocks said second element in said locking position preventing said seocnd element from moving to said releasing position to avoid a revolver discharging when the cylinder is not fastened in the working position.

6. The invention as defined in claim 5 wherein said second element is spring loaded by a spring so that said spring forces said second element to move to said locking position when there is no obstruction to move so.

7. The invention as defined in claim 5 wherein said one element is permitted to perform a longitudinal movement and said other element is permitted to perform a movement which is perpendicular to said longitudrnal movement of said first element.

8. The invention as defined in claim 5 wherein:

(1) said cylinder has an axis of cylinder rotation;

(2) said cylinder has an elongated cylinder chamber having a first and a second ends and having a centre axis coinciding with the axis of cylinder rotation;

(3) said elongated cylinder chamber containing:

(a) a displaceable member having a first and a second ends and having a length at least approximately equal to the length of the cylinder, (b) biasing means which urge said displaceable member toward an initial position in which said first and second ends of the displaceable member do not project from the first and second ends of said elongated cylinder chamber;

(4) said first end of the displaceable member is under the action of said first element when the cylinder is in the working position;

(5) said frame has a cavity adjacent the second end of the elongated cylinder chamber to receive the second end of the displaceable member when the first end of the displaceable member is pressed by said one element and the cylinder is in the working position.

9. In a revolver having a barrel; a hammer; a cylinder having a front surface, a rear surface, a lateral surface and a short projection on said front surface which is immovable relative to said front; a frame having a cylinder recess; said cylinder recess having a front surface and a rear surface; cylinder fastening means fastening the cylinder in a working position in which said cylinder is rotatably mounted in said cylinder recess of the frame; cylinder stopping means stopping the cylinder during a cylinder insertion in said cylinder recess of the frame; said cylinder stopping means arranged so that it stops the cylinder, during its insertion into said recess of the frame, in an intermediate position that permits to said cylinder fastening means to fasten the cylinder in said working position; the improvement in said cylinder stopping means including a shallow recess in said front surface of the cylinder recess of the frame; said shallow recess having an edge which arranged so that it stops said cylinder short projection and thereby the cylinder in said intermediate position during cylinder insertion in said cylinder recess of the frame.

10. The invention as defined in claim 9 wherein:

(1) said cylinder has an axis of cylinder rotation;

(2) said cylinder has an elongated cylinder chamber having a first and a second ends and having a centre axis coinciding with the axis of cylinder rotation;

(3) said elongated cylinder chamber containing:

(a) a displaceable member having a first and a second ends and having a length at least approximately equal to the length of the cylinder, (b) biasing means which urge said displaceable member toward an initial position in which said first and second ends of the displaceable member do not project from the first and second ends of said elongated cylinder chamber;

(4) said first end of the displaceable member is under the action of said cylinder fastening means when the cylinder is in the working position;

(5) said frame has a cavity adjacent the second end of the elongated cylinder chamber to receive the second end of the displaceable member when the first end of the displaceable member is pressed by said cylinder fastening means and the cylinder is in the working position.

11. The invention as defined in claim 9 wherein said edge is located completely inside of said shallow recess.

12. In a changeable cylinder for a revolver using changeable cylinders for fast cylinder replacement and having a frame, a handle, a barrel, a trigger a hammer, a recess in the frame in which the changeable cylinder is rotatably mounted, said changeable cylinder having holes in which cartridges are exposed, the improvement including cartridge holding means to prevent cartridges from falling out from the cylinder cartridge holes when the cylinder is in any position out of said recess in the frame, said cartridge holding means fixed in the rear end of the cylinder and pressing at least one spot of an outer surface of each cartridge to prevent the cartridge from falling out from the cartridge hole of the cylinder. fixing means fastening said cartridge holding means in the cylinder, said fixing means being immovable relative to the cylinder, said cartridge holding means consisting of at least one member exposed on the rear end of the cylinder, said member having at least one resilient contact with each cartridge exposed in its cartridge hole in the cylinder to press and hold by this action the cartridge in the cartridge hole, said member being made of flat resilient metal.

13. The invention as defined in claim 12, wherein said member, which is made of flat resilient metal, is fixed on the rear end of the cylinder by at least one screw having a head which presses said member to said rear end of the cylinder.

14. The invention as defined in claim 12, wherein said member, which is made of flat resilient metal, is fixed on the rear end of the cylinder by at least three screws.

15. In a changeable cylinder for a revolver using changeable cylinders for fast cylinder replacement and having a frame, a handle, a barrel, a trigger, a hammer, a recess in the frame in which the changeable cylinder is rotatably mounted, said changeable cylinder having holes in which cartridges are exposed, the improvement including cartridge holding means to prevent cartridges from falling out from the cylinder cartridge holes when the cylinder is in any position out of said recess in the frame, said cartridge holding means fixed in the rear end of the cylinder and pressing at least one spot of an outer surface of each cartridge to prevent the cartridge from falling out from the cartridge hole of the cylinder, fixing means fastening said cartridge holding means in the cylinder, said fixing means being immovable relative to the cylinder, said cartride holding means including at least one part which is made of non metallic resilient material.

16. The invention as defined in claim 15 wherein said cartridge holding means further include at least two more parts which are made of non metallic resilient material so that said cartride holding means include at least three parts which are made of non metallic resilient material.

17. The invention as defined in claim 16 wherein said fixing means include at least three screws so that each of said three parts, which are made of non metallic resilient material, is fixed in the rear end of the cylinder by one of said three screws.

18. In a changeable cylinder for a revolver using changeable cylinders for fast cylinder replacement and having a frame, a handle, a barrel, a trigger, a hammer, a recess in the frame in which the changeable cylinder is rotatably mounted, said changeable cylinder having holes in which cartridges are exposed, the improvement including cartridge holding means to prevent cartridges from falling out from the cylinder cartridge holes when the cylinder is in any position out of said recess in the frame, said cartridge holding means fixed in the rear end of the cylinder and pressing at least one spot of an outer surface of each cartridge to prevent the cartridge from falling out from the cartridge hole of the cylinder, fixing means fastening said cartridge holding means in the cylinder, said fixing means being immovable relative to the cylinder, said cartridge holding means including at least one spring ring made of wire.

19. In a changeable cylinder for a revolver using changeable cylinders for fast cylinder replacement and having a frame, a handle, a barrel, a trigger, a hammer, a recess in the frame in which the changeable cylinder is rotatably mounted, said changeable cylinder having holes in which cartridges are exposed, the improvement including cartridge holding means to prevent cartridges from falling out from the cylinder cartridge holes when the cylinder is in any position out of said recess in the frame, said cartridge holding means fixed in the rear end of the cylinder and pressing at least one spot of an outer surface of each cartridge to prevent the cartridge from falling out from the cartridge hole of the cylinder, fixing means fastening said cartridge holding means in the cylinder, said fixing means being immovable relative to the cylinder, said cartride holding means consisting of at least one member exposed on the rear end of the cylinder, said member having at least one resilient contact with each cartridge exposed in its cartridge hole in the cylinder to press and hold by this action the cartridge in the cartridge hole, said fixing means including at least one screw, which has a screw head that presses said member to said rear end of the cylinder.

20. In a changeable cylinder for a revolver using changeable cylinders for fast cylinder replacement and having a frame, a handle, a barrel, a trigger, a hammer, a recess in the frame in which the changeable cylinder is rotatably mounted, said changeable cylinder having holes in which cartridges are exposed, the improvement including cartridge holding means to prevent cartrides from falling out from the cylinder cartridge holes when the cylinder is in any position out of said recess in the frame, said cartridge holding means fixed in the rear end of the cylinder and pressing at least one spot of an outer surface of each cartridge to prevent the cartridge from falling out from the cartridge hole of the cylinder, fixing means fastening said cartridge holding means in the cylinder, said fixing means being immovable relative to the cylinder, said fixing means including at least one washer.

21. In a changeable cylinder for a revolver using changeable cylinders for fast cylinder replacement and having a frame, a handle, a barrel, a trigger, a hammer, a recess in the frame in which the changeable cylinder is rotatably mounted, said changeable cylinder having holes in which cartridges are exposed, the improvement including cartridge holding means to prevent cartridges from falling out from the cylinder cartridge holes when the cylinder is in any position out of said recess in the frame, said cartridge holding means fixed in the rear end of the cylinder and pressing at least one spot of an outer surface of each cartridge to prevent the cartridge from falling out from the cartridge hole of the cylinder, fixing means fastening said cartridge holding means in the cylinder, said fixing means being immovable relative to the cylinder, cartridge holding means including at least three wire springs fixed on the rear end of the cylinder by at least screws so that each of said wire springs is fixed by one of said screws.

* * * * *

UNITED STATES PATENT AND TRADEMARK OFFICE

CERTIFICATE OF CORRECTION

PATENT NO. : 4,771,561

DATED : September 20, 1988

INVENTOR(S) : Shimon Waiser

It is certified that error appears in the above-identified patent and that said Letters Patent is hereby corrected as shown below:

Column3, line 9, after "flange" change "11" to --11b--.

Column 6, line 17, after "has" insert --a--.
line 36, "lement" should read --element--.
line 44, "seocnd" should read --second--.
line 53, "one" should read --first--.
line 54, "other" should read --second--.
line 56, "gitudrnal" should read --gitudinal--.
Column 7, line 12, "one" should read --first--.
line 16, after "front" insert --surface--.
line 62, after "trigger" insert --,--.
Column 10, line 26, insert "said" before "cartridge".

Claim 3 should read as follows:

3. The invention as defined in claim 1 wherein said first element is permitted to perform a longitudinal movement and said second element is permitted to perform a movement which is perpendicular to said longitudinal movement of said first element.--;

Column 10, line 28, after "at least" insert --three --.

Signed and Sealed this

Twenty-eighth Day of March, 1989

*Attest:*

DONALD J. QUIGG

*Attesting Officer*

*Commissioner of Patents and Trademarks*